United States Patent [19]

Brinegar et al.

[11] Patent Number: 4,832,112

[45] Date of Patent: May 23, 1989

[54] METHOD OF FORMING A FINE-GRAINED EQUIAXED CASTING

[75] Inventors: John R. Brinegar, North Muskegon, Mich.; Keith R. Chamberlain, Medina, Ohio; James J. Vresics, Hackettstown; William J. DePue, Stillwater, both of N.J.

[73] Assignee: Howmet Corporation, Greenwich, Conn.

[21] Appl. No.: 783,369

[22] Filed: Oct. 3, 1985

[51] Int. Cl.[4] ..... B22D 19/00; B22D 27/02; B22D 27/08

[52] U.S. Cl. ..... 164/499; 164/65; 164/68.1; 164/71.1; 164/76.1; 164/98; 164/122; 164/133; 164/134

[58] Field of Search ..... 164/122, 122.1, 122.2, 164/65, 499, 66.1, 68.1, 76.1, 133, 134, 71.1, 98

[56] References Cited

U.S. PATENT DOCUMENTS

| | | | |
|---|---|---|---|
| 967,830 | 8/1910 | Potter | 164/122 |
| 3,570,713 | 3/1971 | Tromel | 164/122 X |
| 3,861,449 | 1/1975 | Barbero | 164/122 X |
| 4,030,532 | 6/1977 | Tiberg | 164/122 X |
| 4,580,616 | 4/1986 | Watts | 164/122 X |

FOREIGN PATENT DOCUMENTS

| | | | |
|---|---|---|---|
| 842690 | 5/1970 | Canada | 164/122 |
| 2092039A | 8/1982 | United Kingdom | 164/76.1 |

*Primary Examiner*—J. Reed Batten, Jr.
*Attorney, Agent, or Firm*—Finnegan, Henderson, Farabow, Garrett & Dunner

[57] ABSTRACT

A method of forming a fine grained equiaxed casting by melting metal and removing most of the superheat of the molten metal. The molten metal is placed in a mold and optionally subjected to turbulence whereupon it solidifies to form the casting of the desired microstructure.

23 Claims, 3 Drawing Sheets

C101 ALLOY 3" Ø BILLETS CAST AT DCD BY MX PROCESS

MACRO-ETCHED CROSS SECTIONS TAKEN 1/2" and 5" FROM BOTTOM OF BILLET

ACTUAL SIZE PHOTOGRAPHS

C101 ALLOY 3" ø BILLETS CAST AT DCD BY MX PROCESS

MACRO-ETCHED CROSS SECTIONS TAKEN 1/2" and 5" FROM BOTTOM OF BILLET

ACTUAL SIZE PHOTOGRAPHS

C101 ALLOY 3" ø BILLETS CAST AT DCD BY MX PROCESS

MACRO-ETCHED CROSS SECTIONS TAKEN 1/2" and 5" FROM BOTTOM OF BILLET

ACTUAL SIZE PHOTOGRAPHS

METHOD OF FORMING A FINE-GRAINED EQUIAXED CASTING

BACKGROUND OF THE INVENTION

1. Field of the Invention

The present invention relates to a method of forming fine grain equiaxed castings from molten metals.

2. Discussion of the Prior Art

Early wrought superalloys were produced by conventional ingot and hot working technologies. The need for improved properties, primarily in the aerospace propulsion industry, eventually led to the development of more highly alloyed materials which became increasingly difficult to produce in large sizes without significant chemical and microstructural segregation, particularly along the ingot centerline where the metal freezes last. This undesirable condition not only affected forgeability, but also affected the resultant properties of the forgings containing this type of structure.

A conventionally produced casting contains a combination of columnar and coarse equiaxed grains and the resulting grain size of a casting generally is larger as the size of the casting increases. This increases the forces required to forge the material and also the tendency for cracking during hot working operations.

A solution to these problems was the successful adaptation of powder metallurgy approaches to the manufacture of uniform grained and chemically homogeneous products which responded well to forging practice. Furthermore, it developed that such fine grained materials (e.g., ASTM 10-12) were superplastic when deformed at preferred temperatures and strain rates which enabled the production of very near net shapes with relatively modest deformation forces. The fine grain size improves overall forgeability and allows the utilization of isothermal forging procedures. While the latter operation is slow and ties up high capital cost equipment, it has the ability to produce products nearly to final shape and thus avoid the waste and associated machining costs attendant with the removal of excess stock.

The production from metal powders, however, is not without technical shortcomings, especially with respect to superalloys. Superalloy powders usually are produced by atomization in an inert atmosphere and subsequent screening to remove all but the preferred particle sizes. As cleanliness demands have increased, more of the coarser particle fractions are discarded to satisfy this requirement. Typically, 60% yields are expected for the process and this represents a significant premium cost factor for the product. This has inhibited widespread use of such materials where cost is a significant factor.

In addition, superalloy powder metallurgy products are susceptible to quality related problems which can reduce substantially the mechanical properties of the product. These include boundary conditions related to the original powder surface and thermally induced porosity resulting from trapped atomizing and handling gas (e.g., argon). Process controls necessary to avoid these problems can present a substantial expense. Thus, if a casting process could be developed which produces a chemically homogeneous, fine grained add sound product, an alternative to the powder metallurgy process might be realized with lower manufacturing cost.

As noted above, the finer grain, size of the article produced, the better is its forgeability and the associated economics of production are enhanced. Investment castings usually benefit by having the finest possible grains to produce a more uniform product and improved properties, thus it is conventional to control and refine the grain size of the casting through the use of nucleants on the interior surface of the mold. While this produces a degree of grain refinement, the effect is substantially two dimensional and the grains usually are elongated in the direction normal to the mold-metal interface. This condition also occurs without a nucleant where metallic ingot molds are used. In either instance combined use of low metal superheat and low mold temperature, both at the time of pouring, are means by which the grain size can be refined; however, the resultant microstructure remains dendritic and characteristic of traditional foundry processing. The most desirable microstructure would be, in addition to minimum grain size, the presence of a cellular, or nondendritic, structure to facilitate thermal processing procedures. Such a microstructure would result from a high nucleation and freezing rate of the molten metal at the time of casting. Means for achieving this product are described in U.S. Pat. Nos. 3,847,205, 3,920,062 and 4,261,412. Using the techniques disclosed in these references, grain sizes of ASTM 3-5 can be readily achieved.

Other techniques have been employed to refine grain size in both investment casting and ingot manufacture which include the addition of finely distributed solid particles within the melt as nucleation sites. This has found little favor with superalloy users because of undesired compositional changes or the possibility that residual foreign material may provide sites at which premature failure may initiate. Alternatively, the molten alloy may be stirred mechanically, such as in rheocasting, to refine its grain size. This often results in a nondendritic structure containing two components—closely spaced islands of solid surrounded by a matrix of material which remains liquid when the mixing is discontinued—which usually occurs when viscosity increases abruptly at about 50% solidification. This process works well with lower melting point materials. It has not been successful on a commercial scale with superalloys due to their high melting point and the fact that the ceramic paddles or agitators are a source of potential contamination of the melt in the ingot manufacturing process. Reductions of fluidity would preclude the application of rheocasting to the investment casting process.

A more desirable method involves the seeding of the melt as described in U.S. Pat. No. 3,662,810. A related technique, described in U.S. Pat. No. 3,669,180 employs the principle of cooling the alloy to the freezing point to allow nuclei to form, followed by reheating slightly just before the casting operation. If in doing this isolated grains nucleate and grow dendritically in the melt, they may not fully remelt upon reheating thus producing random coarser grains in the final product. Both procedures work but require sophisticated control procedures. In addition, neither address the problem of alloy cleanliness, or inclusion content. This requirement has grown in importance as metallurgical state-of-the-art improvements are made and product design limits are advanced.

Whether casting in an ingot mold or an investment shell it is normal to see a characteristic array of grain structures from the surface to the core of a casting. Adjacent to the surface it is customary to observe a chill zone which usually is nondendritic in nature. Immediately below this zone are columnar dendritic grains lying normal to the surface and parallel to heat flow. One would expect to find a coarse dendritic equiaxed structure below the columnar zone contrary to that observed by this casting practice. The aforementioned columnar condition is unsatisfactory in an investment casting and must be removed by machining or other means from an ingot surface before forging operations are initiated. Failure to do this will cause premature cracking during forging reductions.

It is, therefore, an object of the invention to provide a method for the casting of cellular fine grained ingots, forging preforms and investment castings in which the above disadvantages of the prior art may be obviated.

Specifically, it is an object of the invention to provide a casting having a desired microstructure.

It is an additional object of the invention to form such castings using equipment that can be used on a commercial scale.

It is a further object of the invention to provide castings having little or no surface connected porosity such that hipping of the casting can be successfully employed to eliminate any casting porosity.

Other objects and advantages of the invention may be set out in the description that follows, may be apparent therefrom or may be learned by practice of the invention.

SUMMARY OF THE INVENTION

To achieve these and other objects of the present invention, there is comprised a method for casting a metal article. In the method a metal is melted with the temperature of the molten metal being reduced to remove almost all of the superheat in the molten metal.

It is also preferred that the mold be heated to an appropriate temperature to avoid an initial temperature gradient between molten metal and mold whereby a dendritic columnar zone adjacent to the casting surface may be formed.

DESCRIPTION OF THE PREFERRED EMBODIMENTS

Figure 1:
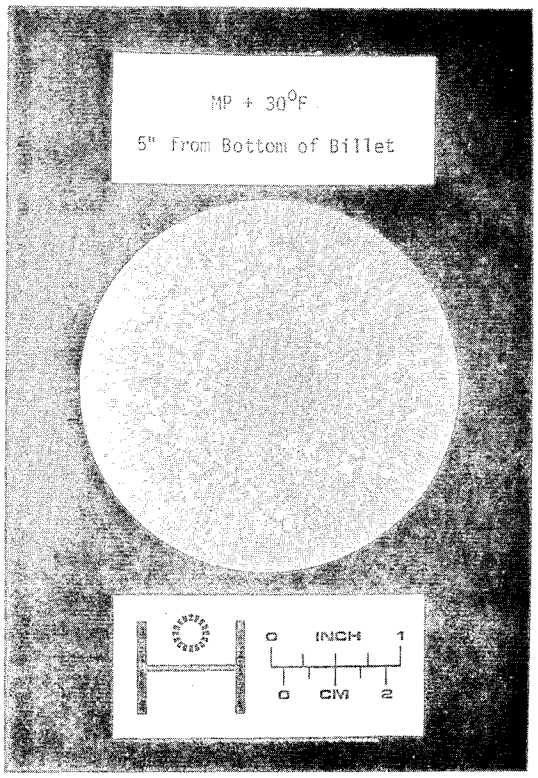
FIG. 1 includes two photomicrographs of a Ni-Cr alloy (C101) cast at 30° F. above the measured melting point.
Figure 1:
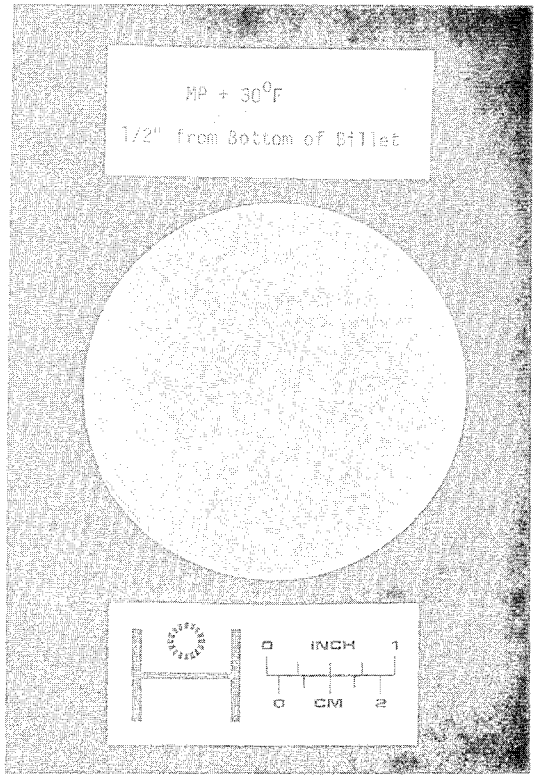

The present invention is a method for casting a metal article to obtain a grain structure that will facilitate either direct usage of the article as with an investment casting or associated thermo-mechanical forming techniques on the metal article. The latter article may be an ingot, a forging preform or some type of preformed article that may be further formed or shaped or otherwise treated to form a final article of the desired mechanical properties.

The present invention finds particular utility for superalloys for the reasons set out in the Background of the Invention portion of the present specification. The process is, however, not limited to any particular material but by way of illustration finds particular utility in forming metal articles of the following materials:

| | Composition w/o | | | | | | | | | | | | | |
|---|---|---|---|---|---|---|---|---|---|---|---|---|---|---|
| Common Name | Cr | Co | Mo | W | Ta | Cb | Al | Ti | C | B | Zr | Hf | Fe | Ni |
| Rene 95 | 14 | 8 | 3.5 | 3.5 | — | 3.5 | 3.5 | 2.5 | 0.04 | 0.01 | 0.05 | — | — | Bal |
| MERL 76 | 12.4 | 18.5 | 3.2 | — | — | 1.4 | 5 | 4.3 | 0.02 | 0.02 | 0.05 | 0.4 | — | Bal |
| C 101 | 12.4 | 9 | 1.9 | 3.8 | 3.9 | — | 3.4 | 4.1 | 0.12 | 0.02 | 0.05 | 1 | — | Bal |
| IN 718 | 19 | — | 3 | — | — | 5.1 | 0.5 | 0.9 | 0.04 | 0.01 | 0.05 | — | 18.5 | Bal |
| MARM 247 | 8.5 | 10 | 0.75 | 10 | 3 | — | 5.5 | 1 | 0.15 | 0.01 | 0.05 | 1.5 | — | Bal |
| IN 713C | 13 | — | 4.5 | — | — | 2 | 6 | 0.8 | 0.12 | 0.01 | 0.05 | — | — | Bal |
| U720 | 18.2 | 14.8 | 3.1 | 1.2 | — | — | 2.48 | 4.99 | 0.04 | 0.03 | 0.03 | — | 0.39 | Bal |
| ASTM F75 | 28 | Bal | 6 | — | — | — | — | — | 0.25 | — | — | — | — | — |
| 17-4 PH* | 16 | — | — | — | — | 0.25 | — | — | 0.03 | — | — | — | Bal | 4 |
| Custom 450** | 14.8 | — | 0.8 | — | — | 0.4 | — | — | 0.03 | — | — | — | Bal | 6.5 |
| 316 Stainless | 17 | — | 2.5 | — | — | — | — | — | 0.04 | — | — | — | Bal | 12 |

*Also 3 Cu.
**Also 1.75 Cu.

The molten metal is placed in a mold and solidified by extracting heat from the mixture at a rate to solidify the molten metal to form said article and to obtain a substantially equiaxed cellular microstructure uniformly throughout the article.

When used to make ingots, turbulence is induced in the molten metal prior to its introduction to the mold or while it is in the mold. This can be done mechanically, as for example, by breaking the mixture into a plurality of streams or droplets at a location adjacent to the entrance of the mold. Another preferred manner of inducing or maintaining turbulence is to electromagnetically stir the molten metal within the mold or to mechanically manipulate the mold once a substantial solid skin is formed.

It is preferred that the molten metal have, at the time of casting, a temperature that is within 20° F. above the measured melting point of the metal.

Use of the present invention with these materials has determined that single phase materials may not retain the fine grain size initially produced by the process due to the lack of a second phase that would pin the grain boundaries. This problem was observed for the martensitic stainless steels set out above, namely 17-4 PH and Custom 450. Such materials may still be operable with the present invention if some means of pinning the grain boundaries of the as-cast material is included in the composition or if some other means of retaining the as-cast grain structure is utilized or if a somewhat coarser grain size can be tolerated. The austenitic stainless steels, e.g., Type 316, have sufficient carbides that grain growth after solidification is inhibited and the beneficial structure of the as-cast material is retained.

After solidification, some of these materials need special cooling cycles in order to prevent grain coarsening. Nickel alloys may require rapid cooling below the solids to about 2150° F., except for IN 718 which should be rapidly cooled to below 2050° F. This rapid cooling prevents detrimental grain growth by solid state processes in the cast material.

The first step in the process of the present invention is melting the metal. This may be done in an inert atmosphere or vacuum depending on the requirements of the metal system being cast. Where the metal system requires an inert or vacuum atmosphere, conventional vacuum induction casting equipment may be employed.

Preferably the molten metal is held in a substantially quiescent state. When heating the melt using induction heating techniques first prior to casting, stirring of the melt should be minimized. This can be done by means of selecting the frequency of the induction field. Where the melt is turbulent or stirred in the pouring crucible undesirable non-metallic impurities are entrained in the melt rather than being isolated at specific locations in the melt. With the non-metallics isolated, the casting process can be selected such that any impurities are kept from the useful portion of the casting.

Where cleanliness of the melt is imperative a crucible heated by a separate susceptor or resistance heater may be used in order to obtain the desired melt temperature without stirring the molten metal.

There are special considerations that must be taken in using such equipment because of the very low superheat of the material being cast. At such low superheats the surface of the molten metal tends to freeze off due to radiation heat losses. Depending on the equipment design, a small area should remain liquid at the melt surface and preferably at the centerline when the preferred casting conditions are met. The molten metal may be poured through this opening at a rapid rate into the properly positioned mold. It is at this opening that temperature measurements associated with the invention are made. Before the next charge can be melted, however, this skull of solidified material should be remelted or otherwise removed before another alloy charge may be cast. Alternatively, a replaceable crucible liner may be employed to avoid this problem.

An improvement on this system can be realized by use of an insulative or reflective cover for the crucible which can be removed when charging or discharging the molten metal into or from the crucible. This has the advantage of avoiding the need to remove the previously mentioned skull or replacing the crucible liner before each casting is made. Another means of dealing with the radiation heat losses at the surface of the molten material may be to modify the temperature profile of the crucible either by modifying the induction coil or resistance heater design or by zone heating of the crucible to balance the heat loss at the surface of the molten material.

The holding of the molten metal such that it remains substantially quiescent is significant with respect to the elimination of solid contaminants in the molten material. The lack of any stirring or motion within the molten material allows any low density non-metallic inclusions to float to the surface where they can be disposed of or eliminated from the casting charge. Certain inclusions such as hafnium oxide have a higher density and would not ordinarily float; however, they normally attach themselves to lower density oxides which provide a net buoyant effect. Operating experience using a quiescent molten material as a source for casting indicates that the problem of solid contaminants as inclusions in the casting may be reduced by the present technique.

Refinements of the basic method of the present invention further eliminate the solid inclusions normally present in such molten materials. Preferably, the crucible in which the metal is initially melted and remains quiescent prior to pouring is a bottom pouring crucible which, because the buoyant solid inclusions are at the upper portions of the crucible, introduce that portion of the charge into the mold system last. With proper design the inclusions are contained in the head or gate portions of the casting and can be removed in subsequent operations. Alternatively, a teapot type crucible may be used which would block the floating inclusions in the crucible from entering the mold until the last portion of the charge is introduced into the system.

Another means of eliminating the buoyant inclusions in the quiescent molten metal involves the use of the insulating or reflective cover disclosed previously that prevents the solidification of metal at the surface of the molten material. Just before pouring the cover is removed allowing a thin surface layer to freeze, thus trapping inclusions in the solid material. By suitable equipment design the solidified material containing the inclusions is not attached to the crucible walls and during the tilt pouring operation the solid material pivots allowing the sub-surface molten materials to flow into the mold. Thus, the disk of solidified metal containing the trapped inclusions may be readily removed from the crucible, thus facilitating preparation of the crucible for the next alloy charge.

Conventional induction heating of the molten material in the crucible results in undesired substantial stirring of the molten metal. In order to maintain the molten material in a quiescent state, a susceptor, usually graphite, can be used between the coil and the crucible. Using such means rapid heating of the metal is possible without stirring the molten material. Alternatively, very high frequencies or resistance heating may be employed to achieve the same results. As indicated above, the lack of stirring or motion within the melt allows any low density nonmetallic inclusions to float to the surface so that the process can be tailored to eliminate such materials from the final casting.

In accordance with the invention, the temperature of the molten metal is reduced to remove up to substantially all of the superheat in the molten metal. This temperature should be substantially uniform throughout the molten material and would, in most alloys, be within 20° F. above the measured melting point of the metal. The low superheat of the metal is principally responsible for the desired microstructure obtained by the present invention.

Figure 2:
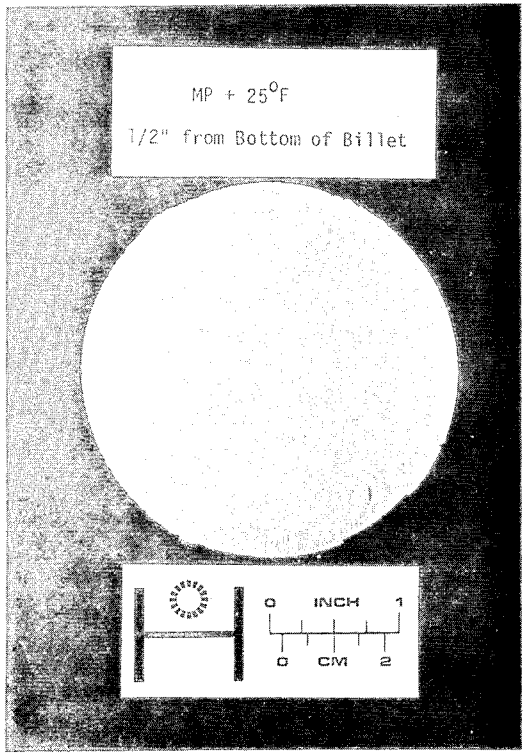
FIG. 2 includes two photomicrographs of a Ni-Cr alloy (C101) cast at 25° F. above the measured melting point.
Figure 2:
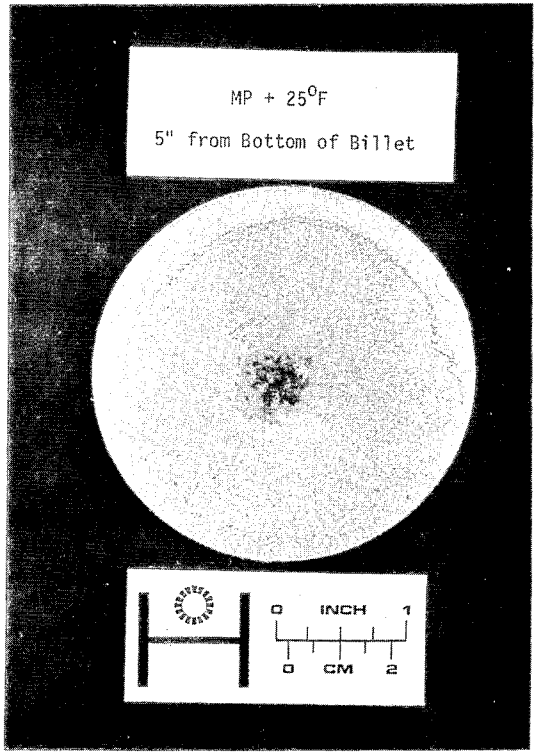
Figure 3:
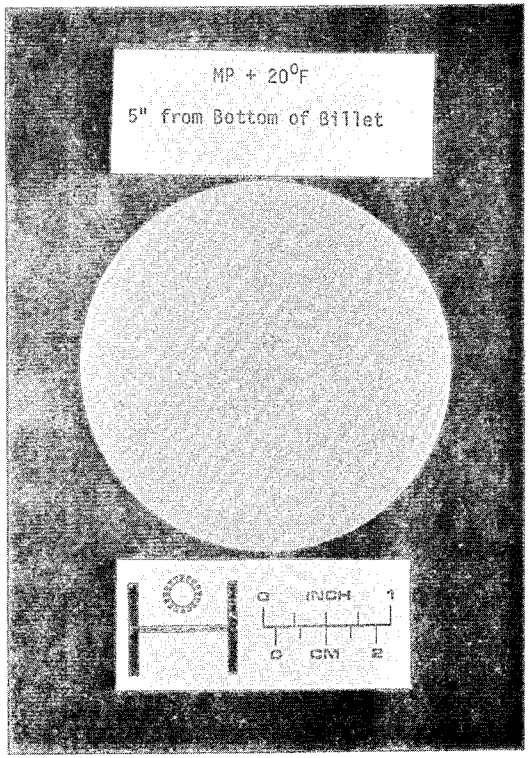
FIG. 3 includes two photomicrographs of a Ni-Cr alloy (C101) cast at 20° F. above the measured melting point.
Figure 3:
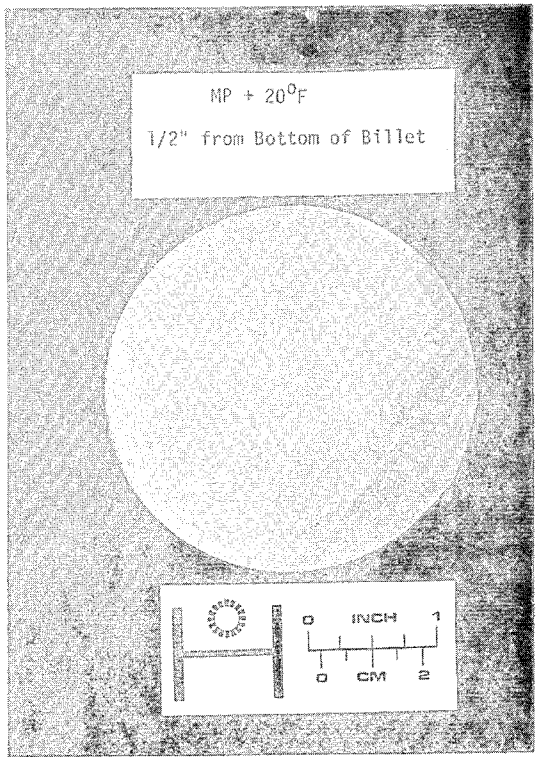

As is evident from the photomicrographs of FIGS. 1–3, the effect of the melt temperature dramatically affects the microstructure. FIG. 1 shows a cross section of a 3″ cast billet at two locations, i.e. at ½″ and at 5″ from the bottom of the billet. While there are fine grains adjacent the portion of the billet that contacted the mold wall (especially in the section ½″ from the bottom), the majority of the billet is comprised of either large dendritic equiaxed grains or columnar grains radiating from the external surface. FIG. 2 shows the same composition sectioned in the same way when the temperature was 5° F. less, at 25° F. above the measured melting point. The grain size in the interior is reduced significantly from that of FIG. 1, but there is still evidence of dendritic columnar grain growth. FIG. 3 shows the same material sectioned in the same way where the casting temperature is 20° F. above the measured melting point. The grain size depicted in FIG. 3 shows the extremely fine equiaxed cellular (nondendritic) grain structure characteristic of the materials formed by the present invention.

As is apparent from the photomicrographs of FIGS. 1–3, the temperature of the melt at the time of casting, with respect to the melting point of the metal being cast (the superheat of the melt) is critical. It has been determined for the metals disclosed above that the temperature at the time of casting should be within 20° F. above the measured melting point or the desired microstructure is not achieved. It is not known if every alloy operable with the present invention has the identical critical range of from 0° to 20° F. above the measured melting point. Based on the specific compositions disclosed herein and the observations with respect to the difference in performance where single phase alloys exhibit grain growth after casting, one skilled in the art to which this invention pertains may determine an operable casting temperature for a particular material without undue experimentation. Therefore, the criticality of the range from 0° to 20° F. is related to the effect on the microstructure and other materials or alloys may achieve the beneficial effect of the invention at casting temperatures slightly greater than 20° F. above the measured melting point.

In some instances, the initial temperature gradient between the liquid metal and a relatively cold mold is sufficiently high to yet produce a zone of dendritic columnar grains at the surface. It has been determined that by increasing the ceramic or metal mold temperature that any remaining traces of columnar dendritic grain may be eliminated.

It should also be noted that the location of temperature measurement or the means of measurement may affect the casting temperature. It is the microstructure obtained by the disclosed process that is significant and the manner in which the temperature is measured is merely the means to obtain that structure. Further, the measured melting point for the metal is determined in the apparatus used in the process for the particular charge being cast. This eliminates any disturbing influence of any variations in the actual melting point on the process. In other words, due to the very small amount of superheat allowed the actual melting point ("measured melting point") for each charge is determined and the casting temperature determined in relation to the measured melting point.

This is accomplished by melting the alloy, adding some superheat, then reducing heat input. The top surface of the melt loses heat more rapidly than the sides and bottom because the latter is in contact with the low conductivity ceramic container. As a result, the top freezes first proceeding from the periphery towards the center. A disappearing filament pyrometer or other suitable temperature measuring device is focused on the center of the melt and when the solidifying front reaches a point where the diameter of the remaining visible molten metal is about 2 inches, a temperature observation is made in this area. This is arbitrarily defined as the measured melting point of that particular charge of molten metal. The required amount of superheat, if any, for the casting process is then added by increasing the heat input to the crucible and charge.

When the casting temperature is low enough and within the above-noted preferred range, the resulting casting achieves a refined cellular grain structure with a grain size of about ASTM 3 or finer. Where there is superheat in an amount in excess of the above-noted range, a coarse grained dendritic microstructure possessing inferior and more varied physical and mechanical properties results from the casting operation. Significantly this effect does not appear to relate to rapid solidification. The effect has been observed in 6" diameter castings that took ten minutes to completely solidify.

Except when making investment castings the molten metal is placed in a mold and preferably turbulence is induced in the molten metal. For most materials it is sufficient to pour the molten metal directly into the mold. The mold may be of a metallic or ceramic material; however, when making ingots or preforms metallic molds are preferred because they prevent the inadvertent introduction of non-metallic inclusions into the casting. If the casting is to be extruded subsequent to the forming operation, a metallic mold has the additional advantage in that it can become the jacket or can surrounding the casting during the extrusion operation.

The turbulence imparted to the mixture may be accomplished in a number of different ways. Turbulence may be induced in the molten metal while the mixture is within the mold. This can be accomplished by electromagnetic stirring. The turbulence may be imparted to the molten metal just prior to its introduction into the mold by mechanical means. For example, the turbulence can be induced by breaking the molten metal into a plurality of streams or droplets at a location adjacent the entrance to the mold. This can be accomplished by the use of strainer cores or turbulators which will form the molten metal into the streams or droplets of the appropriate size. Alternatively, a nozzle may be used as a portion of a crucible that would impart a helical motion to the stream tending to break it into coarse droplets for the purpose of extracting heat from the solidifying alloy by increasing its surface-to-volume ratio.

In accordance with the invention the molten metal is solidified in the mold by extracting heat therefrom at a rate to obtain a substantially equiaxed, cellular, nondendritic grain structure throughout the article and avoid the presence of a dendritic columnar grained zone. As the aspect ratio of the mold increases, it is increasingly important to extract heat more rapidly from the solidifying molten mixture to maintain the fine grain size and associated cellular structure and to minimize the increasing tendency for porosity and possible segregation. This is facilitated by the previously disclosed means of increasing the surface-to-volume ratio of the molten metal during the pouring operation by breaking the stream into a number of smaller streams or into large droplets. In such a manner the molten metal is solidified at a rate that would result in the desirable microstructure for the article, specifically, an equiaxed cellular grain structure having an ASTM grain size of about 3 or finer. As noted above the desirable effect on the structure may be obtained without extremely high solidification rates, although extremely low solidification rates would be expected to increase the grain size.

There may be some porosity in the casting as the natural result of the solidification process and this porosity should be removed to avoid cracking during subsequent forging operations or poorer performance in an investment casting. This can be accomplished by hot isostatic pressing and/or by extrusion. Where hot isostatic pressing will be used for removal of porosity, the mold shape should be designed to avoid surface connected microshrinkage and porosity. The elimination of center line porosity can be accomplished by incorporating an abrupt restriction in the top of the mold to force rapid solidification of the cross section at the top of the casting center line where surface connected centerline porosity would otherwise result.

The present invention has been used in the following specific examples:

EXAMPLE NO. 1

Similar equipment and procedures were used to cast cellular ingots of Rene 95, MERL 76, C 101, IN 713C and IN 718. A three-inch diameter steel mold containing a loose fitting bottom plug consisting of carbon was preheated to 250° F. and then inserted in a lower chamber of a conventional vacuum induction furnace. The alloy to be cast was melted in the upper chamber under vacuum conditions below 5 microns to a temperature 50° F. above the melting point of that particular alloy charge. Power to the induction furnace was gradually reduced until the molten metal was within 0 to 20° F. of its measured melting point. Normally, the casting temperature was approximately +10° F. above the measured melting point. With the molten material at such a temperature, a solidified metal skull formed on the top of the melt. The molten material was poured into the mold which contained a constriction at the top of the mold that forced rapid local freezing at the center line of the casting. This prevented the formation of any interconnected porosity at the center line and allowed densification of the castings where necessary by hot isostatic pressing. Representative castings were densified by a hipping process with the MERL 76, C 101 and IN 713C being hipped at 2190° F., at 25 KSI for 4 hours. The Rene 95 and IN 718 were hipped at 2050° F. at 15 KSI for 4 hours. Hipping of these materials at these particular conditions prevented recrystallization and grain growth of the microstructure. The resulting castings had the fine grain, cellular microstructure characteristic of castings made by the present invention.

EXAMPLE NO. 2

Rene 95 and MERL 76 were cast into 3" diameter ingots of the same configuration in the same manner described above except that the steel mol was replaced with a ceramic mold. The mold was preheated to 1200° F. before insertion into the lower furnace and the process conditions were otherwise identical to those outlined in Example 1. Upon inspection of the resultant castings, there was no observable difference in the grain structure or grain size of the product from that produced in Example 1. By preheating the mold the width of the columnar grained zone was decreased.

EXAMPLE NO. 3

Rene 95 was cast with the same parameters described in Example 2 except that stainless steel was employed instead of carbon steel for the mold. Dimensions selected were such that the mold became the jacket required for subsequent extrusion of the fine grained cast ingot. After extrusion the product possessed a grain size of ASTM 10-11 which is comparable with extruded forging stock produced by powder metallurgy techniques.

EXAMPLE NO. 4

Rene 95 was melted and cast using the mold and procedures set out in Example 1 except that a removable ceramic insulating cover was added to the susceptor headed melt crucible. A small hole in the cover allowed temperature measurement of the melt. Upon achieving a melt temperature of 5° F. above its measured melting point, the insulating cover was removed and a thin layer of metal solidified rapidly on the surface. Upon tilting the crucible to initiate the pouring operation, the solidified material remained horizontal allowing the underlying molten metal to be poured into the steel mold. Subsequent analysis by metallographic means revealed that a substantial concentration of nonmetallic inclusions were trapped in the pre-solidified disk and the cast ingot was markably cleaner using this procedure.

EXAMPLE NO. 5

A vacuum furnace normally employed for directional solidification was utilized because it included two induction heating sources available in a single vacuum chamber. The upper heating source was used to melt a charge the metal which during various runs was between 150 and 300 lbs. depending on the ingot size being cast. The lower induction heating source utilized a susceptor and a bottom pouring crucible. The crucible received the molten charge from the upper furnace and the temperature of the molten metal was adjusted to the proper temperature of between 0° and 20° F. of the measured melting point. After a 10 minute holding period, the ceramic plug at the bottom of the crucible was removed mechanically and the metal was cast into a 6 inch diameter steel mold that was preheated at 250° F. The 10 minute hold period allowed substantially all of the inclusions contained in the molten metal and any ceramic products attributed to the bottom pouring crucible to form a thin film on the surface of the molten metal. This inclusion laden molten metal, because of the bottom pouring characteristics of the crucible, entered the mold last and was contained above the restriction at the top of the mold. Metallographic examination revealed a desired grain size and a substantially cleaner material using such a process. This technique was used on C 101, Rene 95 and MERL 76.

EXAMPLE NO. 6

A 350 lb. charge of C 101 that had been previously refined by electron beam melting techniques was used in a process similar to that set out in Example 4. A 6 inch diameter ingot was cast using the steel mold and stream turbulence was induced during the pouring operation. To induce the turbulence, a steel tube containing a pouring cup fastened to the top, and one-half inch diameter steel rods positioned at 60 degree increments, were welded to the tube walls to form a spoke-like array. This device was placed between the crucible and the mold. During the casting operation, the molten metal stream impinged on the cross pieces, thus forming a plurality of large droplets which then fell into the ingot mold. The resultant grain size was ASTM 4 wherein the grain size of the casting without the induced turbulence was approximately ASTM 2.5.

EXAMPLE NO. 7

A 400 lb. charge of C101 that had been previously refined by electron beam melting was melted in a consumable electrode skull melting furnace to first form a skull and then to melt sufficient alloy for casting into a 6 inch steel ingot mold containing a restriction at the top. Pouring was delayed until a superheat of 10° F. was measured optically. Resultant grain size ranged from ASTM 3–5 and an extremely clean product was produced.

What is claimed is:

1. A method of casting a metal article, said method comprising the steps of:
   (a) melting a metal disposed to form said article to form molten metal;
   (b) reducing the temperature of said molten metal to remove almost all of the superheat in said molten metal to form a molten casting metal consisting of liquid metal;
   (c) providing a mold disposed to receive said molten casting metal, said mold having interior mold walls, said mold being at a temperature sufficiently elevated to prevent substantial columnar grain formation directly adjacent said mold walls;
   (d) placing said molten casting metal in said mold; and
   (e) solidifying said molten casting metal in said mold by extracting heat therefrom at a rate to solidify said molten casting metal to form said article having a substantially equiaxed, cellular nondendritic microstructure uniformly throughout said article.

2. The method of claim 1 including the step of holding said molten casting metal in a quiescent state for sufficient time to allow impurities in the melt to segregate.

3. The method of claim 2 wherein said method includes the step of solidifying the upper portion of said molten casting metal to retain impurities therein.

4. The method of claim 1 including the step of inducing turbulence to said molten casting metal in said mold.

5. The method of claim 4 wherein the step of inducing said turbulence comprises breaking the molten casting metal entering said mold into a plurality of streams.

6. The method of claim 4 wherein the step of inducing said turbulence comprises breaking the molten casting metal entering said mold into a plurality of droplets.

7. A method of casting a nickel-based metal article, said method comprising the steps of:
   (a) melting a nickel-based metal disposed to form said article to form molten nickel-based metal;
   (b) reducing the temperature of said molten nickel-based metal to within about 20° F. above its measured melting point to form molten casting metal consisting of liquid metal;
   (c) providing a mold disposed to receive said molten casting metal, said mold having interior mold walls, said mold being at a temperature sufficiently elevated to prevent substantial columnar grain formation directly adjacent said mold walls;
   (d) placing said molten casting metal in said mold;
   (e) inducing turbulence in said molten casting metal; and
   (f) extracting heat from said molten casting metal at a rate to solidify said molten casting metal to form said article having a substantially equiaxed, cellular nondendritic microstructure throughout said article.

8. The method of claim 7 wherein the step of inducing turbulence in said molten casting metal is carried out prior to said molten casting metal being placed in said mold.

9. The method of claim 7 wherein the step of inducing turbulence is carried out by inductively stirring the molten casting metal in said mold.

10. The method of claim 7 wherein the step of inducing turbulence is carried out by mechanically stirring the molten casting metal in said mold.

11. The method of claim 7 wherein the temperature of the molten casting metal and the rate of heat extraction from the mold combine to form a metal article having a uniform cellular microstructure through said article of ASTM 3 or finer.

12. A method of casting a metal article, said method comprising the steps of:
   (a) melting a metal disposed to form said article in an inert environment to form molten metal;
   (b) maintaining said molten metal in a quiescent state;
   (c) reducing the temperature of said molten metal to a temperature within 20° F. above the measured melting point of said metal to form a molten casting metal consisting of liquid metal;
   (d) providing a mold disposed to receive said molten casting metal, said mold having interior mold walls, said mold being at a temperature sufficiently elevated to prevent substantial columnar grain formation directly adjacent said mold walls;
   (e) placing said molten casting metal in said mold while inducing turbulence to said molten casting metal adjacent the entrance of said mold to increase the surface-to-volume ratio of said molten casting metal; and
   (f) solidifying said molten casting metal in said mold by extracting heat therefrom at a rate sufficient to solidify said molten casting metal to form said article and obtain a substantially equiaxed cellular nondendritic grain structure throughout said article having a grain size of ASTM 3 or finer.

13. The method of claim 12 wherein said method is carried out under a vacuum.

14. The method of claim 12 where the surface/-volume ratio of said molten increased by breaking the molten casting metal from step (c) into a plurality of droplets.

15. The method of claim 12 wherein said metal is multi-phase nickel base alloy.

16. The method of claim 12 wherein said article is forging preform.

17. The method of claim 12 wherein said article is an ingot.

18. The method of claim 12 wherein said article is an investment casting.

19. A method of casting a metal article, said method comprising the steps of:
   (a) melting a metal disposed to form said article to form a molten metal;
   (b) reducing the temperature of said molten metal to remove almost all of the superheat in said molten metal to form a molten casting metal consisting of liquid metal;
   (c) providing a mold disposed to receive said molten casting metal, said mold having interior mold walls;
   (d) preheating said mold to a temperature sufficiently elevated to prevent substantial columnar grain formation directly adjacent said mold walls;
   (e) placing said molten casting metal in said mold; and
   (f) solidifying said molten casting metal in said mold by extracting heat therefrom at a rate to solidify said molten casting metal to form said article having a substantially equiaxed, cellular nondendritic microstructure uniformly throughout said article.

20. The method of claim 19 wherein said mold is comprised of metal.

21. The method of claim 20 wherein a portion of said metal mold comprises a deformable container for a subsequent extrusion operation.

22. The method of claim 19 wherein said mold is comprised of a ceramic material.

23. A method for forming a metal article, said method comprising:

(a) melting a metal disposed to form said article to form molten metal;

(b) reducing the temperature of said molten metal to remove almost all of the superheat in said molten metal to form a molten casting metal consisting of liquid metal;

(c) providing a mold disposed to receive said molten casting metal, said mold including interior mold walls comprised of metal portions, said mold being at a temperature sufficiently elevated to prevent columnar grain formation directly adjacent said metal portions comprising said mold walls;

(d) placing said molten casting metal in said mold;

(e) solidifying said molten casting metal in said mold to form a casting by extracting heat therefrom at a rate such that said molten metal is solidified in the form of a substantially equiaxed, cellular, nondendritic microstructure uniformly throughout said casting; and (f) extruding said casting utilizing said metal portions as a container during the extrusion step.

* * * * *

UNITED STATES PATENT AND TRADEMARK OFFICE

CERTIFICATE OF CORRECTION

PATENT NO. : 4,832,112

DATED : May 23, 1989

INVENTOR(S) : JOHN R. BRINEGAR ET AL.

It is certified that error appears in the above-identified patent and that said Letters Patent is hereby corrected as shown below:

In Claim 14, line 2, after "molten" insert --casting metal is--.

Signed and Sealed this

Thirteenth Day of February, 1990

*Attest:*

JEFFREY M. SAMUELS

*Attesting Officer*

*Acting Commissioner of Patents and Trademarks*